US006877427B2

(12) United States Patent
Dünninger, et al.

(10) Patent No.: US 6,877,427 B2
(45) Date of Patent: Apr. 12, 2005

(54) QUALITY CONTROL DEVICE

(75) Inventors: Reinhold Dünninger, deceased, late of Würzburg (DE); by Brigitte Dünninger, legal representative, Würzburg (DE); Gerald Josef Reinhard, Sulzfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/479,981

(22) PCT Filed: Jun. 6, 2002

(86) PCT No.: PCT/DE02/02042

§ 371 (c)(1),
(2), (4) Date: Dec. 15, 2003

(87) PCT Pub. No.: WO02/102595

PCT Pub. Date: Dec. 27, 2002

(65) Prior Publication Data

US 2004/0173113 A1 Sep. 9, 2004

(30) Foreign Application Priority Data

Jun. 15, 2001 (DE) ..... 101 28 833

(51) Int. Cl.[7] ..... B41F 1/30; B65H 83/00

(52) U.S. Cl. ..... 101/408; 101/409; 101/410; 101/116; 101/120; 271/3.18; 271/3.19; 271/204

(58) Field of Search ..... 101/408, 409, 101/410, 116, 120; 271/3.18, 3.19, 204

(56) References Cited

U.S. PATENT DOCUMENTS

| | | | | |
|---|---|---|---|---|
| 1,625,642 A | | 4/1927 | Droitcour | |
| 3,689,150 A | * | 9/1972 | Gerhard et al. | 355/64 |
| 4,449,813 A | * | 5/1984 | Kikuchi et al. | 399/19 |
| 4,998,716 A | * | 3/1991 | Okumura et al. | 271/297 |
| 5,329,852 A | | 7/1994 | Bolza-Schunemann et al. | |
| 5,476,253 A | * | 12/1995 | Takemoto et al. | 271/4.01 |
| 5,592,878 A | | 1/1997 | Eltner | |
| RE35,495 E | | 4/1997 | Bolza-Schunemann et al. | |
| 5,835,839 A | * | 11/1998 | Kaneda | 399/361 |
| 6,003,859 A | * | 12/1999 | Reist | 271/204 |
| 6,036,187 A | * | 3/2000 | Schaede | 271/204 |
| 6,192,140 B1 | * | 2/2001 | Reinhard et al. | 382/112 |
| 6,681,690 B2 | * | 1/2004 | Schaede | 101/120 |
| 2003/0015106 A1 | * | 1/2003 | Schaede | 101/116 |
| 2003/0218297 A1 | * | 11/2003 | Honegger | 271/204 |

FOREIGN PATENT DOCUMENTS

| | | |
|---|---|---|
| DE | 42 39 561 A1 | 5/1994 |
| DE | 44 36 583 A1 | 4/1996 |
| DE | 42 39 561 C2 | 10/2000 |
| EP | 0 527 453 B1 | 2/1993 |
| EP | 0 527 453 A1 | 2/1993 |
| EP | 0 798 251 A2 | 10/1997 |

* cited by examiner

*Primary Examiner*—Andrew H. Hirshfeld
*Assistant Examiner*—Marvin P Crenshaw
(74) *Attorney, Agent, or Firm*—Jones Tullar & Cooper PC

(57) ABSTRACT

A quality control device includes a suction box, at least one gripper which can be displaced along a suction surface of the suction box, and a CCD camera. A belt, which can be displaced in a sheet transport direction, is disposed on the suction surface of the suction box.

27 Claims, 4 Drawing Sheets

QUALITY CONTROL DEVICE

FIELD OF THE INVENTION

The present invention is directed to a quality control device of an imprinted sheet. A belt is used, in addition to a movable gripper, for pulling the sheet. The sheet conveying direction may be vertical.

BACKGROUND OF THE INVENTION

A quality control device is known from EP 0 527 453 B1. Quality control devices of this type are employed in connection with printing presses for use in taking images of the imprinted sheets and for detecting deviations of those images from a desired print quality. This is accomplished by comparing these sheets with a desired printed image. It is desirable to be able to intervene correctively in the printing process when required.

For this purpose, the above-described device has a suction box with a suction surface, over which suction surface the imprinted sheets are pulled with the aid of sheet grippers. Because of the frictional contact of the sheets with the suction surface of the suction box, it is assured that the sheets are always tightly stretched and that they lie on a well-defined level. It is thus possible to obtain a true image of the sheet with the aid of a camera facing the suction surface.

If such a known device is employed for the quality control of sheets, which have been imprinted on both sides, there is a danger that ink will be smeared over the surface of the sheet which is not controlled and which faces the suction box.

A device for quality control which addresses this problem is described in DE 44 36 583 A1. This prior device is comprised of a drum that is charged with a partial vacuum and a line camera which is facing the jacket of the drum. A gripper pulls the sheets to be controlled through the space between the line camera and the drum, where the sheets rest on the drum as a result of the partial vacuum. The path of the sheets through the quality control device is approximately straight. However, the suction effect provided by the drum causes each of the sheets to be controlled to adhere on a section of the drum in the shape of a segment of a circle. The extension of this section cannot be exactly controlled. It is a function of the stiffness of the sheets to be controlled and of the suction force exerted by the drum. It does not remain constant during the movement of a sheet over the drum. This has the result that, even if the speed of the gripper is exactly constant, the speed of that part of the surface of the sheet to be controlled which touches the drum and which lies within the field of view of the line camera, is subject to fluctuations in an uncontrolled manner. Since these fluctuations are not being taken into consideration in the course of the image capture by the line camera, non-reproducible variations of the results of the image-taking occur. If these fluctuations are not to result in the removal of some good sheets, the comparison of the sheets being printed, with the desired print image, must be "tolerant". This results in the danger that errors actually present in the print image are overlooked.

A suction conveyor for use in a sheet-fed printing press is known from EP 0 798 251 A2, which suction conveyor is comprised of a suction box with a circulating driven belt. This suction box is employed for conveying the sheets at the start or the end of processing in the printing press at locations where sheet grippers, which are used for conducting the sheets between the various stations of the printing process have either not yet gripped them or have already released them.

However, in this device, the suction conveyor is used as the sole conveying mechanism for the sheets. In contrast, in the present invention, the suction belt which is employed is exclusively used for stabilizing, but not for conveying the sheets, which are conveyed by a separate chain gripper system, for the purpose of quality control.

DE 42 39 561 A1 discloses a sheet conveying arrangement in which the start of the sheet is transported by a chain gripper and the imprinted underside of the sheet simultaneously rests on a moving suction belt. Nothing can be found in this document regarding the type of a drive mechanism used and the speed of the suction belt.

SUMMARY OF THE INVENTION

The object of the present invention is directed to providing a quality control device.

In accordance with the present invention, this object is attained by the provision of a device for quality control of an imprinted sheet which has a moving gripper for pulling the sheet, and a suitable CCD camera. In addition, a belt is movable in the sheet conveying direction of the imprinted sheet. The belt can be driven by its own drive motor. The sheet conveying direction of the sheet may be vertical.

The suction box is required in order to be able to conduct a sheet, whose quality is to be checked, through the field of view of the monitoring camera without any chronologically changeable curvature. Smearing of ink, because of friction between the surface of the suction box and the back of the sheet, is prevented. Instead of the suction box surface, a belt, which can be moved together with the sheet, is in contact with the sheet.

A planar camera is preferably used as the camera, so that a complete image can be taken at a given time. Local interferences, with even running of the conveyance of the sheet, cannot lead to errors in taking the images.

In connection with a simple but effective embodiment of the quality control device of the present invention, it is provided that the belt is being driven by the same chain which also guides the sheet gripper. In this way, it is possible to achieve the synchronous running of the belt and the sheet grippers without an elaborate control mechanism.

A first option for coupling the belt with the chain is the use of a chain wheel which is engaged by the chain and which is connected, in a manner fixed against relative rotation, via a chain or a toothed belt drive mechanism with a roller guiding the belt.

With an appropriate layout of the pitch circle diameter of the chain wheel, of the drive transmission, as well as of the exterior diameter of the belt roller, the speed of the belt corresponds exactly to that of the chain. Thus, while being conveyed over the suction surface of the suction box, a sheet which is pulled by a gripper, remains at rest in relation to the belt, so that smearing is prevented. The pitch circle of the chain wheel, or the drive transmission, can also be slightly greater, so that the speed of the belt is slightly less than that of the gripper. This will insure that the sheet rests, tightly pulled and level, on the belt when the camera takes a picture. The difference between the speeds of the sheet and of the belt can be of an order of magnitude of a few percent. In every case, the relative displacement of the sheet and the belt in respect to each other, in the course of the movement of the sheet over the suction box, is substantially less than the movement of the sheet in relation to the suction box, so that the danger of smearing is also clearly reduced, even at different speeds.

A more flexible control is possible if, in accordance with a second preferred embodiment of the present invention, the belt is driven by its own drive motor. The belt drive motor can also be regulated in such a way that the track speed of the gripper corresponds to that of the belt, or at most is slightly greater. In this case, the option is particularly advantageous wherein the track speed is regulated in accordance with the pulling force exerted by the gripper on the sheet in such a way that there is a pulling force, i.e. that the sheet is tensed, but that, on the other hand, a threshold value of the pulling force, which could result in the sliding of the sheet over the belt, is not exceeded.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
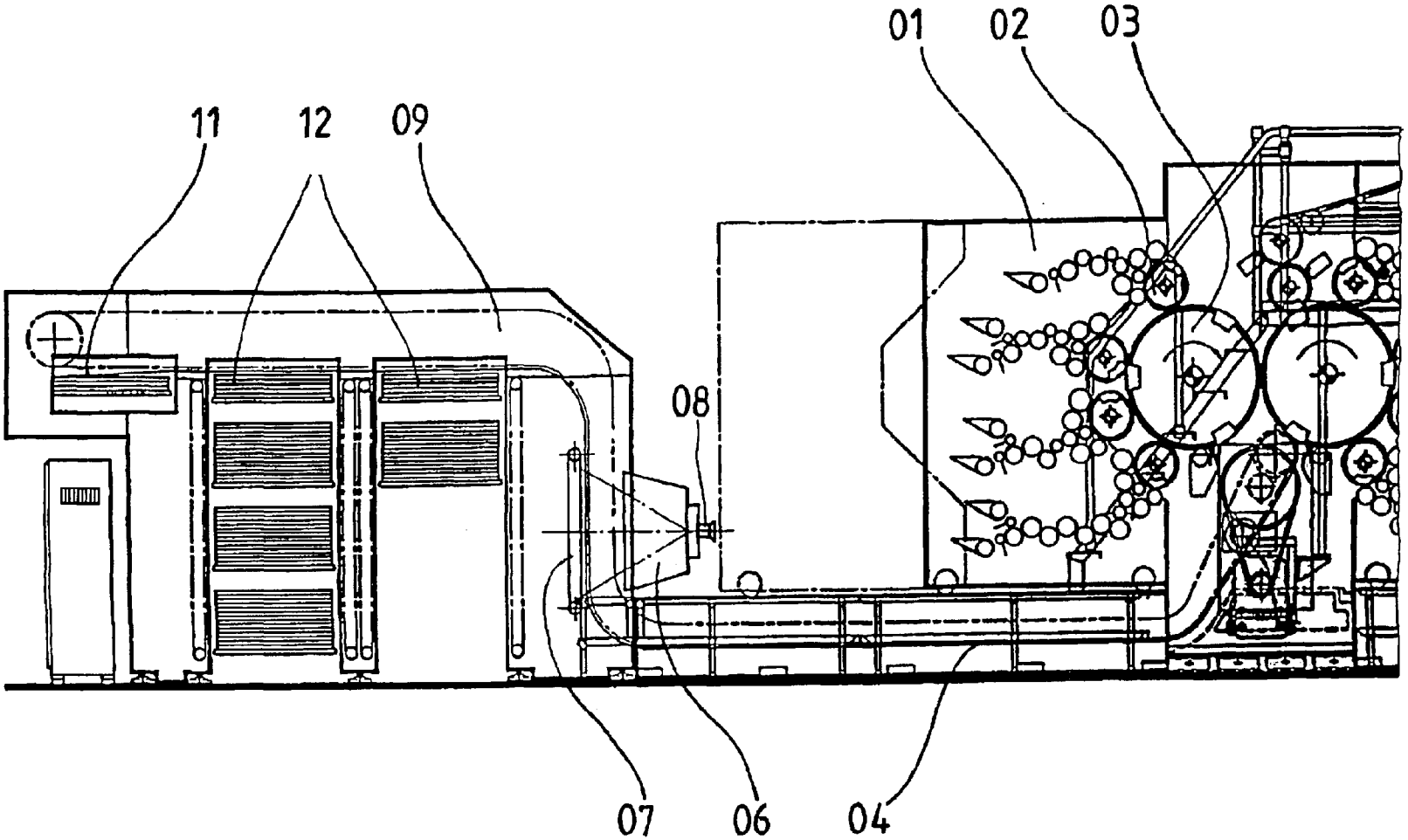
FIG. 1, a schematic side elevation view, partly in section, through a sheet-fed rotary printing press having a quality control device in accordance with the present invention, and in FIGS. 2 to 4, preferred embodiments of the suction box and the belt of the quality control device of the present invention.

A schematic side elevation view through a sheet-fed rotary printing press having a quality control device is shown in FIG. 1. A sheet feeder of the rotary printing press is not represented in FIG. 1. The structure of a printing group, with inking systems 01 and plate cylinders 02, several of which are arranged on a collecting cylinder 03, is known per se and need not be described in greater detail here. Finished sheets, which have been imprinted on both sides, are taken over by a conveying track 04, which has a plurality of chain gripper systems 22 guided on an endless chain, for example grippers. 22. These chain gripper systems 22 are depicted schematically in FIGS. 2–4. The sheets are conducted on the grippers 22 through a quality control device 06, which includes a suction box 07, which suction box 07 is connected to a partial vacuum source, which is not specifically represented, as well as a CCD camera 08, whose field of view is directed onto the suction surface of the suction box 07. The CCD camera 08 is connected with an electronic evaluation device, which is also not specifically represented, and which performs a comparison of the images obtained by the CCD camera 08 with a preselected print image to be obtained, and which electronic evaluation device decides for each detected sheet, in a generally conventional manner, whether or not the detected sheet's print image corresponds to the print image to be obtained. A sheet delivery device 09 is arranged on the conveying track 04 following the quality control device 06 and has two stacks 12, for example two delivery stacks 12 for usable sheets, and one stack 11 for wasted sheets, for example a wasted sheet stack 11. Depending on the result provided by the evaluation device, a sheet is deposited either on one of the delivery stacks 12 for usable sheets, or on the wasted sheet stack 11.

Figure 2:
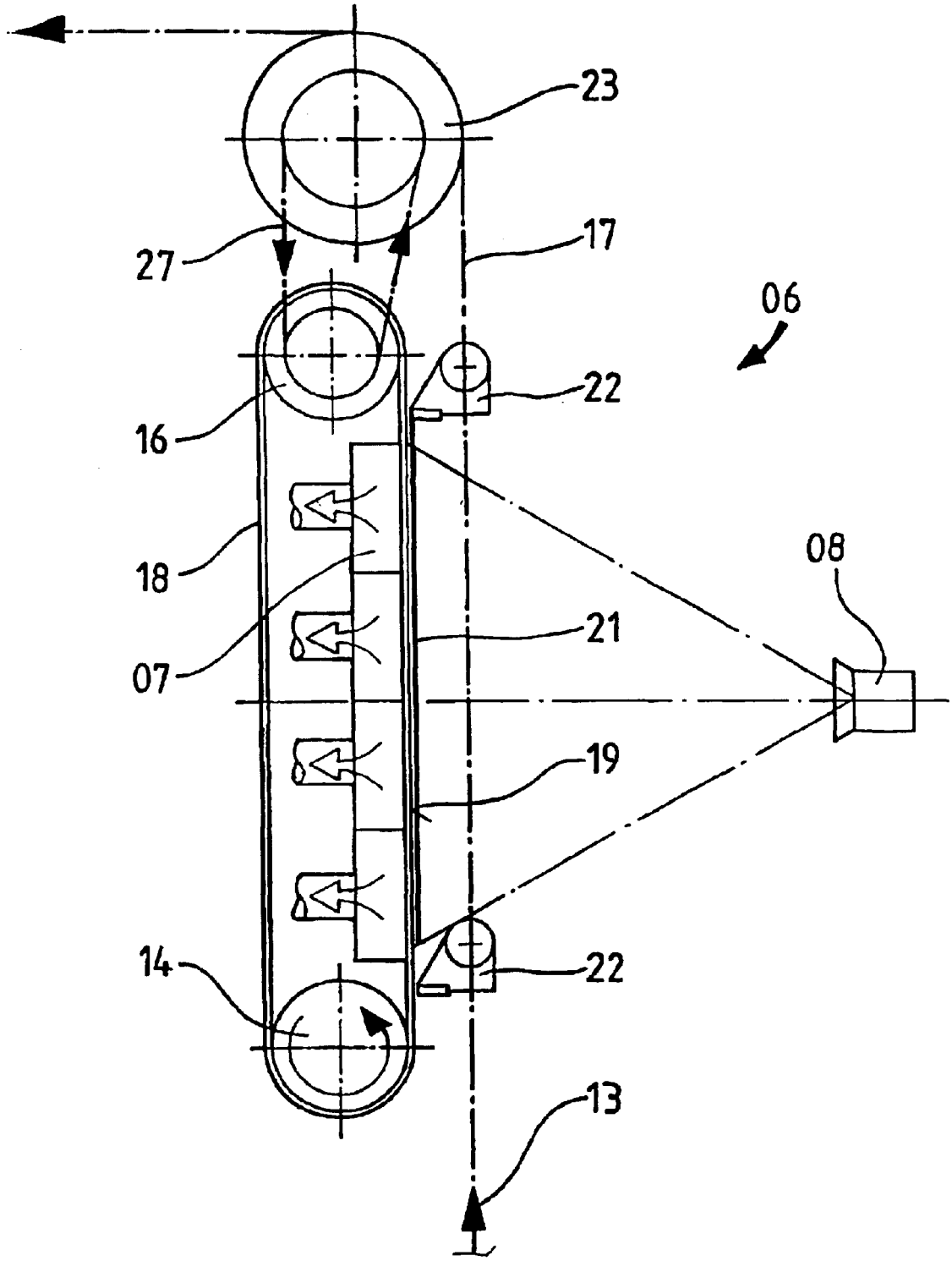

FIG. 2 shows a first preferred embodiment of the suction box 07 of the quality control device 06 of the present invention, and of the components surrounding it. Two guide rollers 14, 16 are rotatably seated on a frame, which is not specifically represented upstream or downstream, respectively, viewed in the sheet conveying direction 13, of the suction box 07. The frame is fixedly connected with guide rails, which are also not represented of a conveyor chain 17 of the conveying track 04. A flexible endless belt 18 has been looped around the guide rollers 14, 16 and is kept under tension by the guide rollers 14, 16. Belt 18 extends over a suction surface 19 of the suction box 07, which suction surface 19 is shown in FIG. 2 as being covered by a sheet 21. Belt 18 extends as well, over the back of suction box 07. The extension or length of the suction surface 19 corresponds to the largest sheet format to be imprinted in the sheet-fed rotary printing press. A plurality of suction lines connected to the side of the suction box 07 are connected with a suction air fan which is used as a partial vacuum source.

The belt 18 consists of a loosely woven or open-weave material, which is easily permeable to air, or of any arbitrary flat material with punched-in or cut-in openings.

Grippers 22 are arranged on the conveyor chain 17 at a distance which is slightly larger than the largest sheet format to be imprinted. FIG. 2 shows a chain wheel 23 which is connected, fixed against relative rotation, to the guide roller 16 by a drive mechanism 27, such as for example, a chain or a toothed belt drive mechanism 27. Chain wheel 23 is in engagement with the conveyor chain 17 and in this way converts a translatory movement of the conveyor chain 17 into a rotational movement of the guide roller 16. A corresponding chain wheel, for engagement with a second conveyor chain of the conveying track 04, is provided on the front face of the guide roller 16 in FIG. 2 facing the viewer; however, this chain wheel, as well as the associated chain, have been omitted for reasons of clarity.

The pitch circle diameter of the chain wheel 23, the transmission ratio of the drive mechanism 27, the thickness of the belt 18, as well as the exterior diameter of the guide roller 16 are dimensioned in such a way that the surface of the belt 18 moves at exactly the same speed as a sheet 21 conveyed by the conveyor chain 17 by operation of grippers 22. When a sheet 21 to be checked passes the quality control device 06, the sheet 21 is pressed against the surface of the belt 18 by an air flow directed onto the suction surface 19. Because of the vertically installed position of the suction box 07, the sheet 21 hangs smoothly, downward under its own weight at this time and therefore is laid smoothly and free of creases onto the surface of the belt 18. When the sheet 21 reaches the position represented in FIG. 2, in which the entire surface of the sheet 21 lies flat on the suction surface 18, the CCD camera 08, which is arranged facing the suction surface 19, generates an image of the sheet 21. A flash is usefully employed for producing the image, so that it is not necessary to slow down the movement of the sheet 21 for creating the image. In the time required for the sheet 21 to be conveyed from the quality control device 06 to the delivery stack 12, a check is made by the image evaluation device, which is not specifically represented to determine whether this is a fault-free or a faulty sheet 21, so that the sheet 21 can be deposited on either the stack 12 or 11 of the sheet delivery device 09 provided for receipt of acceptable or not acceptable sheets.

If sheets 21 that are made of a very soft material, and which therefore tend to fall into folds, are to be processed, it may be useful for the belt 18 to move at a slightly slower speed than the conveyor chain 17, or the gripper 22. It is possible, in this way, for a sheet 21 to be stretched flat to a certain extent, even if the sheet 21 already rests partially or completely on the belt 18. Such a speed ratio can be achieved, in a simple manner, if the pitch circle diameter of the chain wheel 23 is appropriately increased. A comparative result can, of course, also be obtained if the total transmission ratio of exactly 1 is varied by changing the transmission of the drive mechanism 27, by changing the thickness of the belt 18, or by changing the diameter of the guide roller 16 to a total transmission ratio close to 1.

Figure 3:
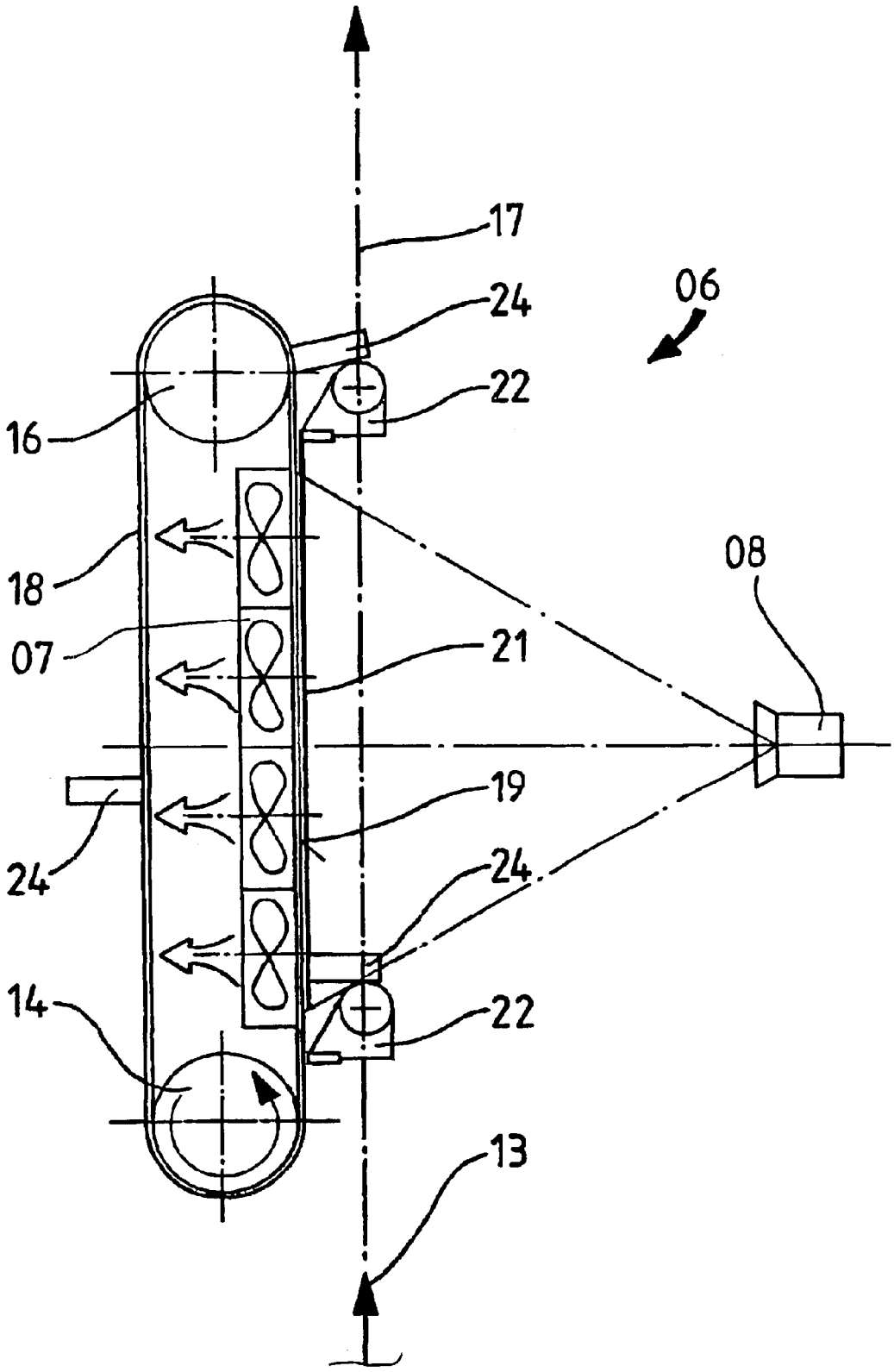

FIG. 3 shows a modification of the first preferred embodiment in FIG. 2, wherein a direct coupling of the guide rollers 14, 16 to the conveyor chain 17 has been omitted. Both guide rollers 14, 16 rotate freely. The driving of the belt 18 is achieved by the use of carriers 24, which carriers 24 are arranged in pairs at the lateral edges of the belt 18 and which project into the track of the grippers 22. These carriers 24 are thus caught by a front edge of a gripper 22 and are pushed along by the movement of chain gripper system 22.

Figure 4:
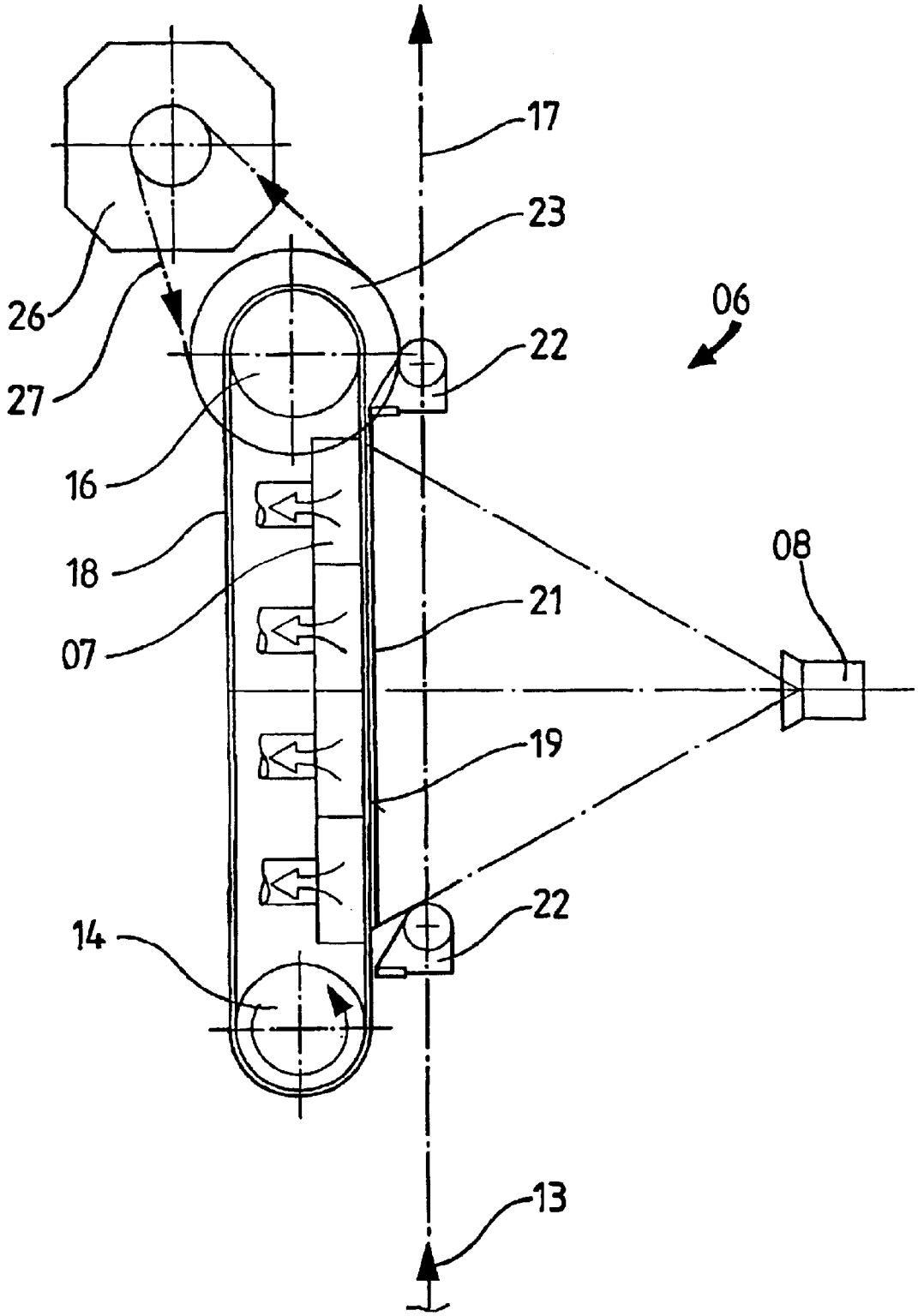

No mechanical coupling between the conveyor chain 17 and the belt 18 is provided in the third preferred embodiment shown in of FIG. 4. Instead, the guide roller 16 has it own motor 26, which motor 26 causes the rotation of the guide roller 16 at a regulated speed. This type of a drive mechanism permits an increased amount of flexibility since, depending on the type of control of the motor 26, the belt 18 can be operated at the exact speed of the grippers 22, or at a slightly reduced speed, which slightly reduced speed of the belt 18, with respect to the grippers 22 and the chain 17 facilitates the tensing of the sheet 21, as described above.

With this third preferred embodiment of FIG. 4 it is also advantageously possible to equip each of the grippers 22 with force sensors for use in measuring a force exerted on a sheet 21, and to regulate the speed of the motor 26 by the use of a control circuit, which is not represented in such a way that the force exerted on a sheet 21 falls slightly below a threshold value of this force. This threshold value is the force needed for displacing a sheet 21, which sheet 21 rests correctly and without folds on the belt 18, with respect to the belt 18. This force is a function of the size of the contact surface or area between the sheet 21 and the belt 18, and therefore, in a fixedly defined and experimentally determinable manner, is a function of the position of the gripper 22. If a sheet 21 is placed on the belt 18 and forms folds, the surface of belt 18 on which the sheet 21 must be displaced, to straighten out the fold, is less than the total contact surface of the sheet 21 with the belt 18. In this way, the force regulation causes these possible folds to be straightened out, but without the entire surface of the sheets 21 being displaced on the belt 18.

While preferred embodiments of a quality control device, in accordance with the present invention have been set forth fully and completely hereinabove, it will be apparent to one of skill in the art that various changes in, for example the type of sheet being inspected, the structure of the inspection camera, the type of sheet grippers, and the like could be made without departing from the true spirit and scope of the present invention which is accordingly to be limited only by the following claims.

What is claimed is:

1. A device for quality control of an imprinted sheet comprising:

a movable gripper adapted to pull a sheet in a sheet conveying direction at a first speed;

a CCD camera;

a belt supported for movement in said sheet conveying direction at a second speed;

a motor for driving said belt;

a drive motor control for regulating said motor to move said belt so that said second speed is not greater than said first speed; and means for sensing a pulling force exerted by said movable gripper on the sheet, said drive motor control regulating said second speed of said belt to not exceed a threshold value of said pulling force.

2. The device of claim 1 further including a suction box having a suction surface and wherein said belt is movable over said suction surface.

3. The device of claim 2 wherein said belt is an endless belt and further including first and second guide rollers spaced about said suction box and supporting said belt looped around said suction box.

4. The device of claim 1 wherein said CCD camera is a planar camera.

5. The device of claim 1 further including a conveyor chain, said gripper being guided by said conveyor chain, said belt being driven by said conveyor chain.

6. The device of claim 5 further including a chain wheel, said chain wheel being in engagement with said conveyor chain, at least one guide roller for said belt, and a drive mechanism between said chain wheel and said at least one guide roller.

7. The device of claim 6 wherein said chain wheel has a pitch circle diameter, said drive mechanism has a transmission and said at least one guide roller has an exterior diameter, said pitch circle diameter, said transmission ratio, said belt thickness and said exterior diameter being selected such that a speed of said belt is no greater than a track speed of said gripper.

8. The device of claim 1 further including carriers on said belt, and wherein said gripper includes a track, said carriers being in engagement with said track of said gripper.

9. The device of claim 1 wherein said sheet conveying direction is vertical.

10. The device of claim 1 further including a sheet feeder and a printing group of a sheet-fed rotary printing press and wherein said device is located between said printing group and said sheet feeder.

11. A device for quality control of an imprinted sheet comprising:

a movable gripper having a first speed and adapted to pull a sheet in a sheet conveying direction;

a CCD camera; and a belt supported for movement at a second speed no greater than said first speed in said sheet conveying direction, said sheet conveying direction being vertical.

12. The device of claim 11 further including a suction box having a suction surface and wherein said belt is movable over said suction surface.

13. The device of claim 12 wherein said belt is an endless belt and further including first and second guide rollers spaced about said suction box and supporting said belt looped around said suction box.

14. The device of claim 11 wherein said CCD camera is a planar camera.

15. The device of claim 11 further including a drive motor for said belt.

16. The device of claim 15 further including a drive motor control device adapted to regulate said motor to drive said belt at a first speed and further wherein said gripper has a second speed, said first speed being no greater than said second speed.

17. The device of claim 16 further wherein said gripper exerts a pulling force on a sheet and wherein said drive motor control device regulates said belt speed whereby a threshold of said pulling force is not exceeded.

18. The device of claim 11 further including a sheet feeder and a printing group of a sheet-fed rotary printing press and wherein said device is located between said printing group and said sheet feeder.

19. A device for quality control of an imprinted sheet comprising:

a movable gripper adapted to pull a sheet conveying direction;

a CCD camera;

a belt supported for movement in said sheet conveying direction, said sheet conveying direction being vertical; and carriers on said belt, said gripper including a track, said carriers being in engagement with said track of said gripper.

20. The device of claim 19 further including a suction box having a suction surface and wherein said belt is movable over said suction surface.

21. The device of claim 20 wherein said belt is an endless belt and further including first and second guide rollers spaced about said suction box and supporting said belt looped around said suction box.

22. The device of claim 19 wherein said CCD camera is a planar camera.

23. The device of claim 19 further including a drive motor for said belt.

24. The device of claim 23 further including a drive motor control device adapted to regulate said motor to drive said belt at a first speed and further wherein said gripper has a second speed, said first speed being no greater than said second speed.

25. The device of claim 24 further wherein said gripper exerts a pulling force on a sheet and wherein said drive motor control device regulates said belt speed whereby a threshold of said pulling force is not exceeded.

26. The device of claim 19 further including a sheet feeder and a printing group of a sheet-fed rotary printing press and wherein said device is located between said printing group and said sheet feeder.

27. A device for quality control of an imprinted sheet comprising:

a movable gripper adapted to pull a sheet in a sheet conveying direction;

a track for said movable gripper;

a CCD camera;

a belt supported for movement in said sheet conveying direction;

a drive motor for said belt; and carriers on said belt, said carriers engaging said track of said grippers.

* * * * *